United States Patent [19]

Takasu et al.

[11] Patent Number: 4,760,007

[45] Date of Patent: Jul. 26, 1988

[54] PROCESS OF DEVELOPING LATENT ELECTROSTATIC IMAGE USING DRY MAGNETIC DEVELOPER

[75] Inventors: Yoshio Takasu, Toride; Tetsuo Hasegawa, Tokyo; Shigeo Kato, Noda; Yoshihiro Nishikawa, Kawasaki, all of Japan

[73] Assignee: Canon Kabushiki Kaisha, Tokyo, Japan

[21] Appl. No.: 774,372

[22] Filed: Sep. 9, 1985

Related U.S. Application Data

[63] Continuation of Ser. No. 484,295, Apr. 12, 1983, abandoned, which is a continuation of Ser. No. 260,586, May 6, 1981, abandoned, which is a continuation of Ser. No. 14,360, Feb. 23, 1979, abandoned.

[30] Foreign Application Priority Data

Feb. 28, 1978 [JP] Japan ..... 53-23049
Mar. 30, 1978 [JP] Japan ..... 53-37076

[51] Int. Cl.[4] ..... G03G 13/09

[52] U.S. Cl. ..... 430/122; 430/106.6; 430/903; 430/904; 430/109

[58] Field of Search ..... 430/109, 106.6, 122, 430/903, 904

[56] References Cited

U.S. PATENT DOCUMENTS

| | | | |
|---|---|---|---|
| 3,239,465 | 3/1966 | Rheinfrank | 430/122 X |
| 3,718,594 | 2/1973 | Miller | 430/109 X |
| 3,776,757 | 12/1973 | Eastman | 430/109 X |
| 3,879,196 | 4/1975 | Nagashima et al. | 430/122 X |
| 3,965,021 | 6/1976 | Clemens | 430/109 |
| 4,161,454 | 7/1979 | Lu . | |

*Primary Examiner*—J. David Welsh
*Attorney, Agent, or Firm*—Fitzpatrick, Cella, Harper & Scinto

[57] ABSTRACT

An improved dry toner for developing latent images is disclosed which comprises essentially a resin and a magnetic powder. The resin includes, as the copolymerization components, at least one monomer selected from the group consisting of styrene and its derivatives and at least one monomer selected from the group consisting of maleic acid and its derivatives.

11 Claims, 1 Drawing Sheet

PROCESS OF DEVELOPING LATENT ELECTROSTATIC IMAGE USING DRY MAGNETIC DEVELOPER

This application is a continuation of application Ser. No. 484,295, filed Apr. 12, 1983, which, in turn, is a continuation of Ser. No. 260,586, filed May 6, 1981, which, in turn, is a continuation of Ser. No. 14,360, filed Feb. 23, 1979, each now abandoned.

BACKGROUND OF THE INVENTION

1. Field of the Invention

The present invention relates to dry toner adapted for developing electrostatic or magnetic latent images in the electrophotographic, electrostatic printing, magnetic recording or other similar processes.

2. Description of the Prior Art

In the art of image formation such as electrophotography and electrostatic recording, there have been known various methods for visualizing or developing latent images electrically formed on the surface of a photosensitive member using a photoconductive material or on a dielectric or an insulating surface of an electrostatic recording member. For example, there may be mentioned the developing methods disclosed in U.S. Pat. Nos. 2,576,047 and 3,081,698 and British Pat. Nos. 1,165,406 and 1,165,405.

In these known developing methods, the development of electorstatic latent image is generally carried out by using electroscopic particles which are selectively attracted or repulsed by the electrostatic charges of the latent image although there is some difference in technique depending upon whether direct reproduction is desired or reversal reproduction is desired. Such electroscopic particles used in developing are usually called "toner". In case of direct reproduction, the tone adheres to the area in which the latent image is present. On the contrary, in case of reversal reproduction, it adheres to the area in which the latent is not present.

The toner can be applied to a latent image carrier surface in various manners to effect developing the latent image. In dry developing process which is most popular at present and in which toner in a form of dry powder is used, there are known and used a magnetic brush method as disclosed in U.S. Pat. No. 2,874,063, a cascade method as disclosed in U.S. Pat. No. 2,618,552 and a powder clouding method as disclosed in U.S. Pat. No. 2,221,776.

Developing agents used in these developing methods may be classified into two groups, that is, those of unitary system comprising solely colored particles, namely toner and those of binary system comprising toner and carrier such as iron powder or glass beads. The first mentioned developing agent is able to develop the latent image by the aid of electric charge derived from an electrically conductive member such as a magnetic metal sleeve used for carrying the developer. The latter mentioned type of the developer is able to develop the latent image by the aid of electric charge derived from frictional charging. A well-known developing method using the unitary system developer is that in which an electrically conductive toner is used. This is disclosed, for example, in U.S. Pat. No. 3,909,258 and Japanese Patent Publication No. 491/1962. According to the method, toner having electric conductivity and magnetism is adhered to a sleeve having a magnet mounted therein so as to form a magnetic brush of toner. The magnetic brush of toner thus formed is brought into contact with an electrostatic latent image carrier to effect developing the latent image with the toner. Since the toner is electrically conductive, when the magnetic brush is placed opposed to the electrostatic latent image, electric charge of opposite polarity to that of the electrostatic latent image is induced in the toner so that the latent image can be developed under the action of electric attraction force existing between the toner having the induced charge and the electrostatic latent image.

The above described developing method using the unitary system of developing agent containing only toner has various advantages as compared to the methods using the binary system of developing agent. When the binary system developing agent is used, it is required to adjust the mixing ratio of toner and carrier, that is, the concentration of toner in the developer. In case of the developing method using the unitary system of developing agent, there is no need of such adjustment. Moreover, it needs no mixing operation of developer which is otherwise required to electrically charge the developer. Therefore, the developing method can be carried out with a developing apparatus which is simple in structure and compact in arrangement. Another advantage of the above described developing method is found in the fact that it has no problem of the quality degradation of developed images caused by the deterioration of carrier with the lapse of time.

While the above described developing method has such various advantages over other developing methods, its use has been limited only to the case wherein an electrostatic latent image is formed on a photosensitive paper coated with a photosensitive material such as zinc oxide and the latent image is developed directly with toner and the developed image is fixed on the paper. However, the developing system which is used most widely in the art at present comprises a transferring step in which a developed image is transferred to a trasnfer sheet such as an ordinary paper from the photosensitive medium. The above described method can not be applied to this developing system without a great difficulty and inconvenience. This is because electrically conductive toner which gives a limitation to the transferring operation is used in the above described developing method. For example, when such conductive toner is used in the corona transferring process, it gives rise to many difficulties. The corona transferring process is a transferring process in which a toner image formed on an electorstatic latent image carrier is brought into contact with a transfer sheet and an electric charge is applied from the backside surface of the transfer sheet by corona discharge to effect transferring the toner image. In this process, if the toner is electrically conductive, then a weak corona current passing through the transfer sheet will make the toner particles have the same polarity of electric charge as the transfer sheet has. This results in an insufficient transfer of the toner image. Furthermore, since all the toner particles in a toner layer are made to have electric charges of the same polarity, developed images may be disturbed by the repulsion among the toner particles. Japanese Patent Application Laid Open No. 45639/1975 describes a developing method of elestrostatic latent images in which an electrically insulating and magnetic toner is used and the toner is charged by using the friction electricity charging effect produced between the toner and the surface of toner supporting member to develop the electrostatic latent image. According to the description of the specification of this patent application, it is also possible to electrostatically transfer the developed toner image. However, because of the high content of magnetic material dispsersed therein in a form of fine particles, this insulating magnetic toner is not so good or not so stable with respect to its chargeability. The triboelectric charge thereof often varies during the use, and therefore, it is difficult to repeatedly produce good images in a stable manner.

It is also known to add an electric charge controlling agent such as Nigrosine dye or metal containing dye to a magnetic toner, but the addition of such electric charge controlling agent to the magnetic toner brings forth some problems. In making a large number of copies, dye contained in the magnetic toner becomes adhered to or absorbed to the surface of toner supporting member more and more and finally the friction chargeability of toner is reduced extremely. For this reason, use of the charge controlling dye is not preferable.

SUMMARY OF THE INVENTION

Accordingly, it is a general object of the present invention to provide a dry toner which eliminates the above described disadvantages of conventional known dry developing toners.

More specifically, it is an object of the invention to provide a dry toner which is excellent in electric chargeability and shows always stable chargeability during its use, and which enables to produce sharp and clear images without any fogging.

It is another object of the invention to provide a magnetic toner which exhibits good and uniform magnetism when used as a developing agent of unitary system containing no carrier or as a developing agent for magnetic printing and which enables to electrostatically transfer the toner image.

It is a further object of the invention to provide the above mentioned dry toner which is also excellenet in fluidity and impact resistance and involves no problem of aggregation.

It is a still further object of the invention to provide a dry toner which minimizes a trouble of adhesion of toner to a toner supporting member and/or latent image supporting member.

An even further object of the invention is to provide a dry toner of good fixability.

According to the present invention, there is provided a dry toner comprising a resin containing, as copolymerization components, at least one monomer selected from the group consisting of styrene and its derivatives and at least one other monomer selected from the group consisting of maleic acid and its derivatives, and a magnetic fine powder.

Other and further objects, features and advantages of the invention will appear more fully from the following description taken in connection with the accompanying drawing.

BRIEF DESCRIPTION OF THE DRAWING

The single figure is a schematic sectional view of a developing apparatus using a magnetic toner.

DESCRIPTION OF THE PREFERRED EMBODIMENTS

Figure 1:
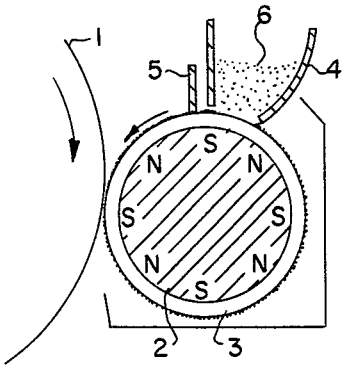

Examples of styrene and its derivative used in the invention include styrene, vinyl toluene, chlorostyrene, dichlorostyrene, bromostyrene, dibromostyrene, divinylbenzene, α-methyl styrene and the like.

Examples of maleic acid and its derivative used in the invention include maleic acid, maleic anhydride, mono- or di-esters of maleic acid with alcohol preferably having 1 to 18 carbon atoms, fumeric acid and the like.

Preferable copolymer resin used in the invention is a copolymerisate of the above mentioned monomers having a molecular weight in the range of from 5,000 to 50,000 and a softening point in the range of from 80° to 160° C. (measured by the ball and ring method). Among them, block copolymers are preferable. The copolymer of the above mentioned monomers may be further esterified completely or partially. The resins particularly preferably used in the invention are those prepared by partial esterification of copolymer of styrene monomer and maleic anhydride.

In preparing the copolymer resin used in the invention, the polymerization molar ratio of styrene monomer to maleic monomer is usually about 100:10–150, preferably 100:10–70. The use of maleic component is an amount less than the above described range will produce a magnetic toner which is poor in durability and has a reduced electric chargeability. When many copies are made using such magnetic toner, the reduction of image density and the increase of fogging become remarkable with the increase of number of copies produced. On the contrary, the use of maleic component in an amount larger than the above limit will give such toner lacking in uniformity of magnetic toner properties and, in particular, poor in moisture resistance which makes the toner unsuitable for practical use. Besides, the use of higher content of maleic component brings forth such inconvenience that kneading of molten mixture using a roll mill becomes impossible although the formation of toner may be carried out by using a spray dry method.

Synthesis of the copolymer resin in the invention may be carried out by employing a conventional polymerization technique such as block polymerization.

In addition to the styrene monomer and maleic monomer, another monomer may be added for copolymerization to produce the copolymer so long as the effect of the present invention is not decreased. The content of such additional monomer, if used, is generally less than 50 mol %. In particular, by adding an acrylic and/or a methacrylic ester with such alcohol having 1 to 8, preferably 1 to 4 carbon atoms, in an amount of 10 to 50, preferably 15 to 35 mol %, there is obtained a resin having a good electric chargeability and flexibility which is more suitable for the purpose of the present invention.

While the above defined copolymer resin can serve alone as a very suitable binder material for the magnetic toner of the invention, its mixture with other resin or resins also may be used to further improve the physical properties of the toner so long as the content of other resin does not diminish the effect of the present invention. In this connection, it should be noted that when other binder resin is used together with the above defined copolymer resin, the above defined copolymer resin should be present in the binder material in an amount of at least 40% by weight to obtain the effect of the invention. The content of the copolymer resin particularly defined by the present invention in a mixture of resins is preferably more than 50% by weight and the user of content more than 60% by weight is particularly preferable.

Any natural or synthetic resin conventionally used as a binder material for toner may be admixed with the above defined copolymer resin. Examples of such binder material for toner are as follows:

Homopolymers of styrene and its substituted derivatives such as polystyrene, poly-p-chlorostyrene, polyvinyltoluene and the like; styrene copolymers such as styrene-p-chlorostyrene copolymer, styrene-propylene copolymer, styrene-vinyltoluene copolymer, styrene-vinylnaphthalene copolymer, styrene-acrylate copolymer, styrene-methacrylate copolymer, styrene-α-chloromethyl methacrylate copolymer, styrene-acrylnitrile copolymer, styrene-vinyl methyl ether copolymer, styrene-vinyl ethyl ether copolymer, styrene-vinyl methyl ketone copolymer, styrene-butadiene copolymer, styrene-isoprene copolymer and styrene-acrylonitrile-indene copolymer; polyvinyl chloride, natural resin modified phenolic resins, natural resin modified maleic resins, acrylic resins, polyvinyl acetate, silicone resins, polyethylene, polypropylene, polyseter resins, polyurethane, polyamide resins, ionomer resin, furan resin, epoxy resins, xylene resins, polyvinyl butyral, terpene resin, indenecumarone resin, chlorinated paraffin, paraffin wax and the like.

The magnetic material used in the invention may be any material which exhibits magnetism or which is magnetizable. For example, fine powder of metal such as iron, manganese, nickel, cobalt and chromium; ferrites; magnetites; alloys and compounds of iron, cobalt, nickel or manganese; and other known magnetic material such as ferromagnetic alloys may be used. This magnetic material is incorporated into the aimed toner in a form of fine particles of particle size 0.1–5 μ, preferably 0.1–1 μ, in an amount of 1–50 % by weight, preferably 5–40 % weight based on the total weight of the toner.

The toner according to the invention can be prepared by a conventional method. If desired, the toner may be prepared as encapsulated toner.

The toner according to the invention generally has a particle size of from 0.5 to 100 μ. Particle size in the range of from 1 to 40 μ is preferable.

If necessary, a coloring agent such as pigment and dye, for example, carbon black and Phthalocyanine Blue, an electric charge controlling agent, a fixation accelerator and/or a fluidity improving agent may be incorporated into the toner.

The magnetic toner according to the invention may be used also as an electrically conductive magnetic toner. In this case, the conductive magnetic toner does not have the properties of chargeability and electrostatic transferability, but it can retain all other good properties which the magnetic toner according to the invention has. Therefore, in the light of the present invention, there is obtained a conductive magnetic toner of good properties, in particular, having an excellent durability.

For magnetic toner used in magnetic printing it is generally required to have all of the good properties obtained by the present invention with only one exception of chargeability. Therefore, the magnetic toner in accordance with the invention may be advantageously used as a magnetic toner for developing magnetic latent images.

The toner according to the present invention can be fixed also using heating roller and exhibits a good fixability. There occurs no problem of offsetting of toner to the heating roller or sticking of the transfer sheet onto the heating roller. Moreover, the toner of the present invention is very excellent in transferability for electrostatic transferring process such as corona transferring process. With the toner according to the invention there is obtained a well transferred image of high sharpness.

The present invention is illustrated by the following examples. These examples are intended to illustrate the invention and are not to be construed to limit the scope of the invention. Unless otherwise stated, "parts" are parts by weight throughout all the examples.

EXAMPLE 1

Copolymer resins were prepared by the block copolymerization of styrene and maleic acid isobutyl half ester, with various ratios of the styrene monomer to the maleate monomer.

100 parts of any one of the resins and 30 parts of magnetite (Trade name; EPT-1000, a product of Toda Kogyo, Japan) were molten and well kneaded together by a roller mill. Thereafter, the mixture was pulverized by a jet mill pulverizer. Thus, a magnetic toner was prepared which had an average particle size of 10–15 μ. However, in case of the resin of Sample A, it was difficult to knead by using the roller mill. Therefore, the magnetite was dispersed in a solution of the Sample A resin in methyl ethyl ketone and the dispersion was sprayed through a spray dryer to form a magnetic toner.

Using the magnetic toner prepared in the above described manner, a positive electrostatic latent image was developed in a known developing apparatus as shown in FIG. 1. The developed toner image was transferred to a transfer sheet by the corona transferring process and then fixed in a conventional manner. A clear and sharp image was obtained without fogging every time.

In FIG. 1, the reference numeral 1 designates a photo-sensitive drum. The developing apparatus comprises a rotatable sleeve 3 made of stainless steel and having a stationary magnet 2 mounted therein. b 4 is a toner supplying device and 6 is a magnetic toner. When the sleeve 3 is rotated, the magnetic toner 6 is drawn to the surface of the sleeve by the magnetic attraction force and, as the sleeve rotates, the toner is brought into contact with the electrostatic latent image carrying part of the photosensitive drum to develop the electrostatic latent image on the drum. A doctor blade 5 provided at the outlet of the toner supplying device controls the amount of toner supplied to the sleeve surface. Electric charge is applied to the toner by the friction charging effect resulting from the friction between the toner and the sleeve. The toners used in Example 1 exhibit negative chargeability.

Maximum image density and fog density measured at the initial copying run and after 10,000 copying runs are given in the following Table 1 together with the data of copolymerization ratio used in the example.

TABLE 1

| Resin Sample | copolymerization ratio styrene:maleate (molar ratio) | at initial run image density | at initial run fog density | after 10,000 runs image density | after 10,000 runs fog density |
|---|---|---|---|---|---|
| A | 100:100 | 1.32 | 0.02 | 1.33 | 0.02 |
| B | 100:70 | 1.32 | 0.02 | 1.32 | 0.02 |
| C | 100:50 | 1.29 | 0.02 | 1.29 | 0.02 |
| D | 100:30 | 1.26 | 0.01 | 1.24 | 0.02 |
| E | 100:10 | 1.10 | 0.01 | 1.09 | 0.01 |
| F | 100:5 | 0.89 | 0.02 | 0.63 | 0.12 |

(Com-

TABLE 1-continued

| Resin Sample | copolymerization ratio styrene:maleate (molar ratio) | at initial run image density | at initial run fog density | after 10,000 runs image density | after 10,000 runs fog density |
|---|---|---|---|---|---|
| parative) | | | | | |

EXAMPLES 2–11

The procedure described in Example 1 was repeated using many different copolymer resins according to the invention and good results were obtained for all the cases of Examples 2–11.

Styrenic monomer components and maleic monomer components used in preparing the copolymer resins and the results obtained are shown in Table 2.

this toner ranged from 5 to 25 μ and the average size was 10 to 15μ.

Triboelectric charge of this toner on a 400 mesh stainless steel screen was measured and found to be −6.7 μc/g.

This toner was introduced, without blending with any other toner, into the developing device of a dry type electrocopying machine (Trade name NP 5000; a copying machine manufactured by CANON K.K.) and a copying test was conducted. Sharp and fog free images were obtained.

A durability test of the toner was also conducted by a 10,000 sheets copying running. It was found that the copy produced after such a large number of copying runs could have an image as good as that produced at the initial run.

TABLE 2

| Example | Copolymer resin (molar ratio) styrenic component | maleic component | at initial run image density | at initial run fog density | after 10,000 runs image density | after 10,000 runs fog density |
|---|---|---|---|---|---|---|
| 2 | styrene (100) | maleic anhydride (40) | 1.25 | 0.02 | 1.18 | 0.02 |
| 3 | styrene (100) | maleic acid (40) | 1.35 | 0.02 | 1.22 | 0.02 |
| 4 | styrene (100) | monoethyl maleate (40) | 1.21 | 0.02 | 1.23 | 0.02 |
| 5 | styrene (100) | octyl maleate (30) | 1.10 | 0.02 | 1.12 | 0.02 |
| 6 | styrene (100) | maleic acid (20) isobutyl maleate (20) | 1.28 | 0.02 | 1.24 | 0.03 |
| 7 | p-chlorostyrene (100) | isopropyl maleate (40) | 1.15 | 0.03 | 1.20 | 0.02 |
| 8 | divinylbenzene (100) | isopropyl maleate (40) | 1.08 | 0.02 | 1.06 | 0.02 |
| 9 | α-methyl styrene (100) | isopropyl maleate (40) | 1.10 | 0.01 | 1.07 | 0.02 |
| 10 | dibromostyrene (100) | isopropyl maleate (40) | 1.30 | 0.02 | 1.28 | 0.02 |
| 11 | vinyltoluene (100) | isopropyl maleate (40) | 1.21 | 0.02 | 1.11 | 0.02 |

EXAMPLE 12

Styrene and maleic anhydride at a molar ratio of 1:1 were block copolymerizated. About $\frac{1}{4}$, $\frac{1}{2}$ and $\frac{3}{4}$ of the maleic anhydride component in the resulting copolymer were partially esterfied respectively so as to prepare copolymer resins used in the toner according to the invention. Using these copolymer resins, the procedure described in Example 1 was repeated. Good results were obtained for all the cases. Even when the magnetite was replaced by other magnetic fine powder such as that of $\gamma$-$Fe_2O_3$, Co-$\gamma$-$Fe_2O_3$ and the like, almost the same good results were obtained respectively.

EXAMPLE 13

| | |
|---|---|
| Styrene-maleic anhydride-butyl acrylate copolymer monomer ratio (50:15:35) | 100 parts |
| magnetite | 25 parts |
| and carbon black | 3 parts |

were mixed together. The resultant mixture was molten and well kneaded by a roller mill. Thereafter, the mixture was pulverized by a jet mill. Thus, a toner according to the invention was prepared. The particle size of

EXAMPLE 14

The procedure described in Example 13 was repeated with the exception that the monomer ratio of styrene-maleic anhydride-butyl acrylate copolymer was changed to 70:10:20.

Triboelectric charge of the toner was found to be −6.5 μc/g. With this toner, good images of high sharpness and free of fogging were obtained. Image reflection density was 1.38 and fog reflection density was 0.02.

EXAMPLE 15

The procedure described in Example 13 was repeated with the exception that the monomer ratio of styrene-maleic anhydride-butyl acrylate copolymer was changed to 50:30:20.

There was obtained a triboelectric charge of the toner which was found to be −6.1 μc/g. Copying operation with this toner produced a clear and sharp image which was free of fog. Its image reflection density was 1.33 and fog reflection density was 0.02.

EXAMPLES 16–24

The procedure described in Example 1 was repeated using various toners according to the invention. The resin compositions of the toners used in the experiments and the test results obtained by the experiments are shown in Table 3.

TABLE 3

| Example | Copolymer (monomer ratio) styrenic component | maleic component | acrylic component | Additive resin (wt % in toner resin) | at initial run image density | at initial run fog density | after 10,000 runs image density | after 10,000 runs fog density |
|---|---|---|---|---|---|---|---|---|
| 16 | styrene (50) | maleic anhydride (20) | methyl methacrylate (30) | polystyrene (30) | 1.24 | 0.02 | 1.23 | 0.03 |
| 17 | styrene (60) | maleic acid (15) | butyl acrylate (25) | polystyrene (10) | 1.35 | 0.02 | 1.26 | 0.02 |
| 18 | styrene (50) | isobutyl maleate (30) | ethyl acrylate (20) | styrene-butadiene copolymer | 1.43 | 0.03 | 1.34 | 0.03 |

TABLE 3-continued

| Example | Copolymer (monomer ratio) styrenic component | maleic component | acrylic component | Additive resin (wt % in toner resin) | at initial run image density | fog density | after 10,000 runs image density | fog density |
|---|---|---|---|---|---|---|---|---|
| 19 | styrene (70) | octyl maleate (20) | butyl methacrylate (10) | (15/85) (40) styrene-butadiene copolymer (15/85) (50) | 1.39 | 0.02 | 1.31 | 0.03 |
| 20 | styrene (50) | isopropyl maleate (15) | butyl acrylate (35) | — | 1.41 | 0.03 | 1.39 | 0.03 |
| 21 | p-chlorostyrene (60) | maleic anhydride (20) | butyl acrylate (20) | — | 1.29 | 0.02 | 1.24 | 0.02 |
| 22 | divinylbenzene (50) | isopropyl maleate (15) | butyl acrylate (35) | — | 1.33 | 0.03 | 1.21 | 0.03 |
| 23 | α-methyl styrene (50) | monoethyl maleate (15) | methyl acrylate (35) | — | 1.26 | 0.02 | 1.19 | 0.02 |
| 24 | vinyltoluene (60) | isopropyl maleate (20) | butyl acrylate (20) | — | 1.35 | 0.02 | 1.26 | 0.03 |

EXAMPLE 25

Styrene, maleic anhydride and butyl acrylate at a monomer ratio of 50:15:35 were block copolymerized. The maleic anhydride component in the resultant copolymer was partially esterified to produce a copolymer resin used in the invention. Using this toner, the procedure described in Example 1 was repeated. A clear and sharp image was obtained without fogging.

EXAMPLE 26

| | |
|---|---|
| polyethylene oxide (density; 0.99, melt index 1,000) and | 100 parts |
| magnetite (Trade name; EPT-1000, a product of Toda Kogyo) | 50 parts |

were mixed together and the mixture was well kneaded by a roller mill at 150° C. for thirty (30) minutes. Thereafter, the mixture was pulverized by a jet powdering machine to produce a powder of 3–10 μ in particle size. This powder was thoroughly dispersed into a 20% methyl ethyl ketone solution of styrene-maleic anhydride-butyl acrylate compolymer (monomer ratio: 50:15:35). This liquid was then sprayed through a spray dryer to form an encapsulated toner having a particle size of 5–15 μ. Triboelectric charge of the encapsulated magnetic toner on a 400 mesh stainless steel screen was measured and found to be −7.1 μc/g.

The above magnetic toner was introduced along into the developing device of a dry type electrocopying machine (Trade name NP-5000, manufactured by CANON K. K.). Only the fixing device of the copying machine was replaced by a roller fixing device made by Develop Company (which comprises two chrome plated rigid upper and lower rollers with its total pressure being 460 kg). With this copying machine charged with the above described toner according to the invention, copying tests were conducted. Clear and sharp images were obtained without fogging. The durability of the toner was tested by a continuous 30,000 sheets copying running. Even after such a large number of runs there was obtained an image of high quality and good fixability comparable to those of the image produced at the initial runs. Triboelectric charge of the toner measured after the 30,000 copying runs were −6.8 μc/g.

What we claim is:

1. An image forming method, comprising the steps of:

forming an electrostatic latent image on the surface of a photosensitive member;

rotating a sleeve having a stationary magnet therein;

applying triboelectric charge to a tribochargeable dry magnetic colored toner by friction between said toner and said sleeve without using a carrier, said toner having a particle size ranging from 1 to 40 microns and comprising a binder resin containing at least 40% by weight of a copolymer of at least (A) at least one monomer selected from the group consisting of vinyl toluene, chlorostyrene, dichlorostyrene, bromostyrene, dibromostyrene, divinylbenzene, alpha-methylstyrene and styrene and (B) at least one other monomer selected from the group consisting of maleic anhydride, maleic acid esters of maleic acid with alcohol having from 1 to 18 carbon atoms, fumaric acid and maleic acid, and from 1 to 50% by weight of magnetic fine powder, wherein the molar ratio (A):(B) is 100:10–70;

developing said electrostatic latent images with the toner having triboelectric charge to obtain a toner image;

transferring the obtained toner image ot a transfer sheet by a corona transferring process; and fixing the transferred toner image on said transfer sheet by a heating roller fixing device or by a pressure roller fixing device.

2. An image forming method as claimed in claim 1, wherein the colored toner is a negatively tribochargeable dry magnetic colored toner having a particle size ranging from 1 to 40 microns.

3. An image forming method as claimed in claim 1, wherein the transfer sheet is an ordinary paper.

4. An image forming method as claimed in claim 1, wherein the binder resin contains at least 40% by weight of the copolymer.

5. An image forming method as claimed in claim 1, wherien the colored toner is a negatively tribochargeable dry magnetic colored toner having a particle size ranging from 1 to 40 microns, said toner comprising the binder resin and magnetic fine powder having a particle size between 0.1 and 1 microns, wherein said binder resin comprises at least 40% by weight of a copolymer of at least (A) at least one monomer selected from the group consisting of vinyl toluene, chlorostyrene, dichlorostyrene, bromostyrene, debromostyrene, divinylbenzene, alpha-methylstyrene and styrene and (B) at least one other monomer selected from the group consisting of maleic anhydride, maleic acid esters of maleic acid with alcohol having 1 to 18 carbon atoms, fumaric acid and maleic acid, wherein the molar ratio (A):(B) is 100:10–70 and wherein the softening point of said copolymer measured by the ball and ring method is in the range of from 80° to 160° C.

6. An image forming method, comprising the steps of:

forming an electrostatic latent image on the surface of a photosensitive member;

rotating a sleeve having a stationary magnet therein;

applying triboelectric charge to a tirbochargeable dry magnetic colored toner by friction between said toner and said sleeve without using a carrier, said toner comprising a binder resin containing at least 40% by weight of a copolymer of (A) at least one monomer selected from the group consisting of vinyl toluene, chlorostyrene, dichlorostyrene, bromostyrene, dibromostyrene, divinylbenzene, alpha-methylstyrene and styrene, (B) at least one monomer selected from the group consisting of maleic anhydride, maleic acid esters of maleic acid with alcohol having from 1 to 18 carbon atoms, fumaric acid and maleic acid, and (C) at least one monomer selected from the group consisting of acrylic acid esters of acrylic acid with alcohol having from 1 to 8 carbon atoms and methacrylic acid esters of methacrylic acid with alcohol having from 1 to 8 carbon atoms;

developing said electrostatic latent image with the toner having triboelectric charge to obtain a toner image;

transferring the obtained toner image to a transfer sheet by a corona transferring process; and fixing the transferred toner image on said transfer sheet by a heating roller fixing device or by a pressure roller fixing device.

7. An image forming method as claimed in claim 6, wherein the colored toner is a negatively tribochargeable dry toner having a particle size ranging from 1 to 40 microns.

8. An image forming method as claimed in claim 6, wherein the transfer sheet is an ordinary paper.

9. An image forming method as claimed in claim 7, wherein the binder resin contains at least 40% by weight of the copolymer.

10. An image forming method as claimed in claim 9, wherein the colored toner contains 1–50% by weight of magnetic fine powder based on the total weight of said toner.

11. An image forming method as claimed in claim 6, wherein the colored toner is a negatively tribochargeable dry colored toner having a particle size ranging from 1 to 40 microns, said toner comprising the binder resin, wherein said binder resin comprises at least 40% by weight of a copolymer of (A) at least one monomer selected from the group consisting of vinyl toluene, chlorostyrene, dichlorostyrene, bromostyrene, dibromostyrene, divinylbenzene, alpha-methylstyrene and styrene, (B) at least one monomer selected from the group consisting of maleic acid with alcohol having 1 to 18 carbon atoms, fumaric acid and maleic acid, and (C) at least one monomer selected from the group consisting of acrylic acid esters of acrylic acid with alcohol having 1 to 8 carbon atoms and methacrylic acid esters of methacrylic acid with an alcohol having 1 to 8 carbon atoms, wherein the molar ratio (A):(B) is 100:10–150 and the amount of (C) is in the range of from 1 to 50 molar percent of said copolymer and wherein the softening point of said copolymer measured by the ball and ring method is in the range of from 80° to 160° C.

* * * * *

UNITED STATES PATENT AND TRADEMARK OFFICE

CERTIFICATE OF CORRECTION

PATENT NO. : 4,760,007

DATED : July 26, 1988

INVENTOR(S) : YOSHIO TAKASU, ET AL.

It is certified that error appears in the above-identified patent and that said Letters Patent is hereby corrected as shown below:

COLUMN 6

Line 39, "b" should be deleted.

COLUMN 9

Line 49, "along" should be deleted.

COLUMN 10

Line 42, "ot" should read --to--.
Line 57, "wherien" should read --wherein--.
Line 65, "debromostyrene," should read --dibromostyrene,--.

COLUMN 11

Line 10, "tirbochargeable" should read --tribochargeable--.

Signed and Sealed this

Fourteenth Day of February, 1989

*Attest:*

DONALD J. QUIGG

*Attesting Officer*

*Commissioner of Patents and Trademarks*